US005525865A

United States Patent [19]

Simpson

[11] Patent Number: 5,525,865

[45] Date of Patent: Jun. 11, 1996

[54] COMPACT MICROWAVE SOURCE FOR EXCITING ELECTRODELESS LAMPS

[75] Inventor: James E. Simpson, Gaithersburg, Md.

[73] Assignee: Fusion Lighting, Inc., Rockville, Md.

[21] Appl. No.: 202,185

[22] Filed: Feb. 25, 1994

[51] Int. Cl.[6] ..... H01J 65/04

[52] U.S. Cl. ..... 315/39; 315/39.53; 315/248; 315/344

[58] Field of Search ..... 333/26; 315/39, 315/39.53, 248, 344

[56] References Cited

U.S. PATENT DOCUMENTS

| | | | |
|---|---|---|---|
| 2,737,610 | 3/1956 | Allaire et al. | 315/39 |
| 3,942,058 | 3/1976 | Haugsjaa et al. | 315/248 X |
| 4,001,631 | 1/1977 | McNeill et al. | 315/39 |
| 4,792,725 | 12/1988 | Levy et al. | 315/39 |
| 4,902,935 | 2/1990 | Wood | 315/248 X |
| 4,928,040 | 5/1990 | Uesaki | 315/39 X |
| 5,216,327 | 6/1993 | Myers et al. | 315/39.53 |

FOREIGN PATENT DOCUMENTS

| | | | |
|---|---|---|---|
| 468176 | 9/1950 | Canada | 315/39 |

*Primary Examiner*—Benny T. Lee
*Attorney, Agent, or Firm*—Pollock, Vande Sande & Priddy

[57] ABSTRACT

Apparatus for exciting electrodeless lamps. A magnetron for generating electromagnetic energy in the microwave region includes an extension for its antenna terminal. The extension extends the length of the antenna to control the phase of loading on the magnetron. A circular ground flange and perforated screen enclose the electrodeless lamp, permitting microwave energy to excite the gas within the lamp, while confining the energy to the space bounded by the perforated screen and cylindrical ground flange. The extension for the antenna has a length which maintains the reflection coefficient phase to a level which does not adversely disturb the magnetron operating frequency.

12 Claims, 6 Drawing Sheets

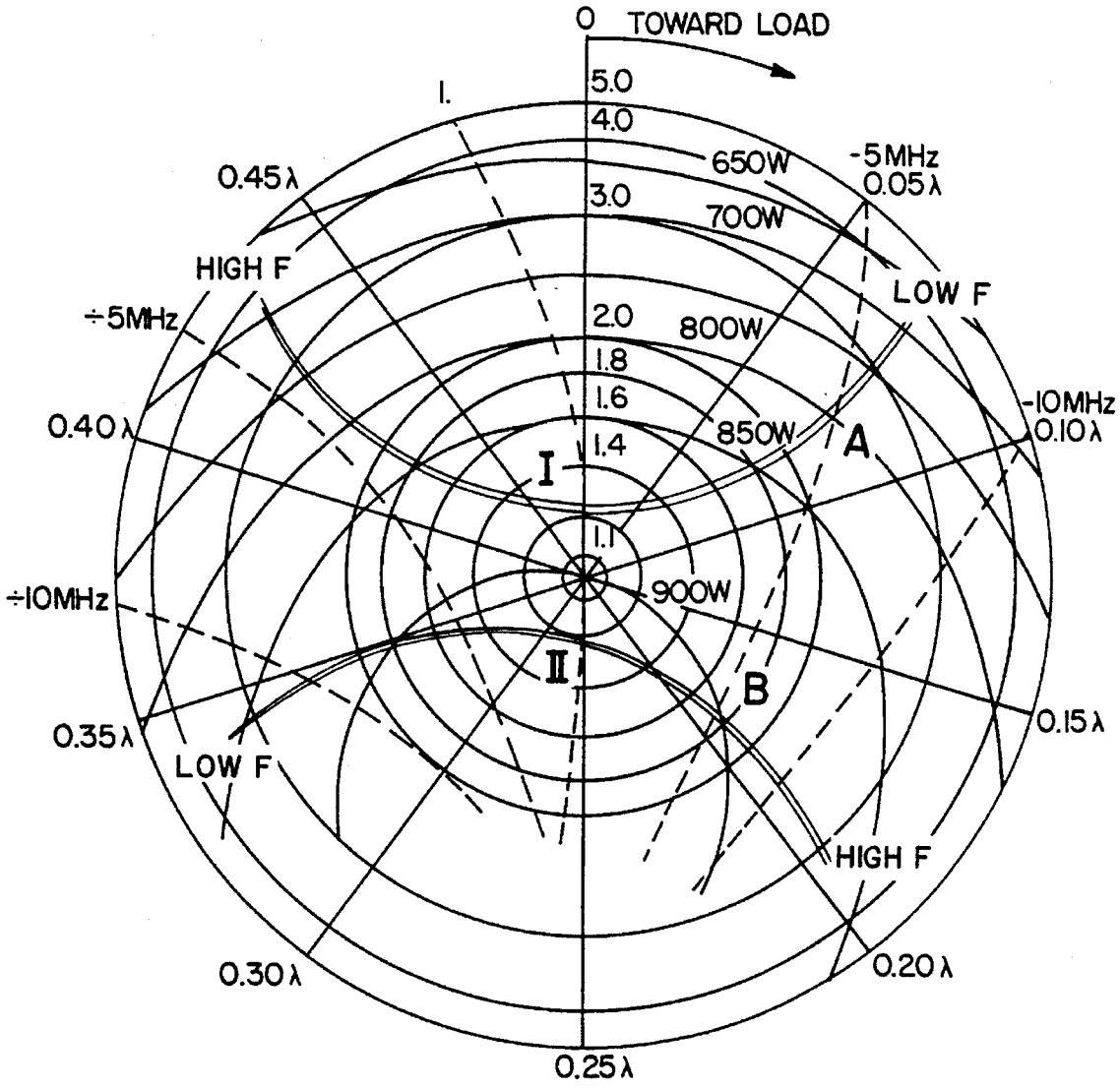
FIG. IC

COMPACT MICROWAVE SOURCE FOR EXCITING ELECTRODELESS LAMPS

RELATED APPLICATIONS

This application is related to U.S. Ser. No. 08/141,961 by James E. Simpson.

BACKGROUND OF THE INVENTION

The present invention relates to a system for exciting electrodeless lamps with microwave electromagnetic radiation. Specifically, a compact microwave frequency power source is coupled to an electrodeless lamp with a minimum of waveguide structure or coupling devices.

Microwave powered electrodeless lamps have been used in various industrial processes for generating ultraviolet light used to cure materials and/or in other manufacturing processes. The electrodeless lamps have the desirable characteristic of a long life, with unchanging light spectrum, as well as a high-intensity light output. These lamps are excited by microwave energy generated by a magnetron which was originally intended for use in microwave ovens. The conventional microwave generating magnetrons include an output antenna which is coupled via a waveguide structure and perhaps an isolator to such an oven or to an electrodeless lamp which terminates one end of the microwave waveguide structure.

Applications for the electrodeless lamp outside the industrial processing technologies are currently being developed. One application requiring a high intensity visible light source includes projection television systems. In these systems, a source of white light is filtered into the primary red, green and blue colors. The separated colors are modulated by a light valve panel with a video signal representing the red, green and blue content of a video image. The modulated monochrome images are recombined in a dichroic mirror structure to form a single color image. The resulting color image is projected to a display screen using a projection lens.

These consumer applications for electrodeless lamps impose space and weight limitations not found in the earlier industrial applications on the light source. Hence, it is desirable to provide for coupling of the lamp to a microwave source with a minimal amount of microwave waveguide structure and/or coupling devices such as isolators, which burden the system with their weight and size requirements.

In order to derive the required light output from the electrodeless lamps, it is necessary to match substantially the impedance presented by the electrodeless lamp to the output of the magnetron power source. The need to remove the size and weight imposed by the waveguide structures and coupling devices of the prior art is accompanied by a need to maintain the impedance match between the electrodeless lamp and microwave source. Any substantial mismatch will not only deliver less power to the electrodeless lamp, which is converted to luminant energy, but will also create standing waves which, depending upon their phase, can shift the frequency of the magnetron source, further mismatching the electrodeless lamp to the source, and commensurately reducing the available light output.

SUMMARY OF THE INVENTION

It is an object of this invention to couple an electrodeless lamp directly to a magnetron microwave source.

It is a more specific object of this invention to couple an electrodeless lamp to a magnetron in a substantially impedance-matched condition to minimize frequency shift of the magnetron source which results from standing waves.

These and other objects are provided for by the invention. An electrodeless lamp is coupled to a source of microwave power in a substantially impedance-matched condition with a minimal standing wave condition between the terminating electrodeless lamp and microwave source. The magnetron output antenna terminal may be extended a length which will provide a maximum electric E field to the electrodeless lamp. A metallic screen is employed around the electrodeless lamp and is electrically connected to the magnetron common terminal for confining the microwave radiation while permitting high intensity light to be radiated.

In the preferred embodiment of the invention, the electrodeless lamp is rotated about a rotating axis which is perpendicular to the axis of the magnetron antenna. The rotation provides for cooling of the lamp as well as a better distribution of the microwave energy in the gas molecules contained within the electrodeless lamp.

In various embodiments of the invention, the length of the antenna is extended so as to match the impedance of the electrodeless lamp to the magnetron output impedance and to provide a favorable phase relationship.

In a preferred embodiment of the invention, the device includes a coaxial transmission line extension having an outer conductor which encloses the periphery of the magnetron antenna, and an inner conductor connected to the antenna. The coaxial transmission line extension provides impedance matching between the electrodeless lamp and the magnetron, while providing a maximum E field excitation for the electrodeless Damp.

DESCRIPTION OF THE FIGURES

FIG. 1C is a Rieke diagram having two possible output impedances superimposed on the magnetron antenna.

DESCRIPTION OF THE PREFERRED EMBODIMENT

Figure 1A:
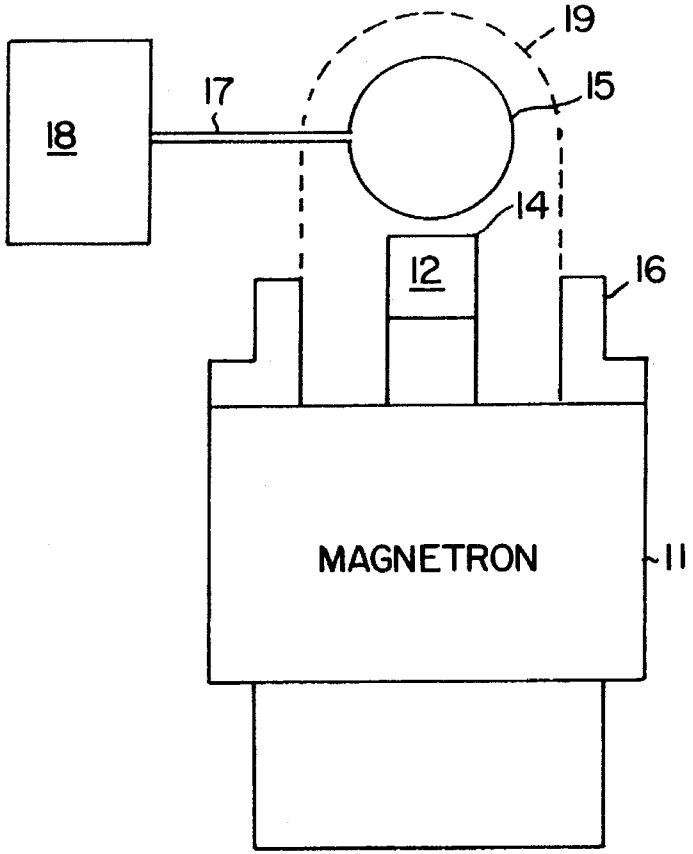
FIG. 1A illustrates a first embodiment of the invention wherein a magnetron directly excites a large size electrodeless lamp.

Referring now to FIG. 1A, there is shown a first embodiment of the present invention suitable for large bulbs. A magnetron 11 produces microwave radiation in the ISM band. The microwave energy is extracted through a metal antenna 12.

The magnetron 11 is attached to cylindrical flange 16 which encloses the antenna 12. A perforated screen 19, electrically connected to the cylindrical flange 16, is shown which encloses the electrodeless lamp 15, and antenna 12 which has a permanently attached metal cap 14.

The electrodeless lamp 15 includes a fill gas, such as argon, and contains a volatile fill material, such as sulfur. The argon is ionized by microwave radiation launched from the antenna 12.

The perforated screen 19 permits light generated from the electrodeless lamp 15 to be radiated while confining microwave radiation to the volume bounded by screen 19 and cylindrical flange 16. A motor 18 supports the electrodeless lamp 15 on its shaft 17. By rotating electrodeless lamp 15 about an axis perpendicular to the axis of the magnetron antenna, a substantially even illumination of the gas fill of the lamp 15 is obtained, along with some beneficial cooling effects. In operation, the lamp 15 is directly excited by high frequency electric field from the magnetron antenna 12. The electric flux path from the antenna 12 through the electrodeless lamp 15 terminates on the perforated metal screen which is electrically connected via the cylindrical flange 16 to the magnetron anode.

During operation, the lamp starts by ionizing the fill gas which, in the preferred embodiment, may be argon, and heats until the volatile fill material combined with the fill gas, such as sulfur, is fully vaporized. During this start-up process, a varying impedance is reflected from the electrodeless lamp 15 back to the magnetron. The shift in impedance, and therefore reflection coefficient, tends to shift the frequency of operation for the magnetron, in accordance with FIG. 1B, and reduces the power output of the magnetron 11.

Various techniques have been employed in the past, including the use of isolators for eliminating the effects of reflection coefficient on the magnetron 11 operating frequency, as well as various impedance matching devices to shift the phase of the reflection coefficient such that it does not significantly effect the operating frequency.

These additional microwave structures, including waveguide matching sections and isolators add significant weight and size to the entire electrodeless lamp package. It is therefore desirable to eliminate these additional microwave structures in favor of a more compact and lighter weight structure.

In doing so, the effects of reflection coefficient on the operating frequency of the magnetron must not result in the reduction of power delivered to an electrodeless lamp.

A high RF voltage is produced by the magnetron at the top of the antenna 12, similar to the voltage that would occur when the antenna is inserted into a rectangular waveguide. This voltage couples via a displacement current to the electrodeless lamp bulb 15. The gas forming a plasma in lamp 15 is heated resistively by the current. The circuit is completed, again by displacement current, to the surrounding grounded metal screen 19 and cylindrical flange 16.

The impedance presented to the antenna 12 is that of a resistor in series with a capacitor. For optimum tuning, an inductance is required which may be formed by keeping cylindrical flange 16 of large diameter. All circuits for tuning the lamp bulb 15 will be resonant in nature. For a fixed plasma condition, the impedance of the lamp bulb 15 will follow a circular path when plotted as a function of frequency.

Figure 1B:
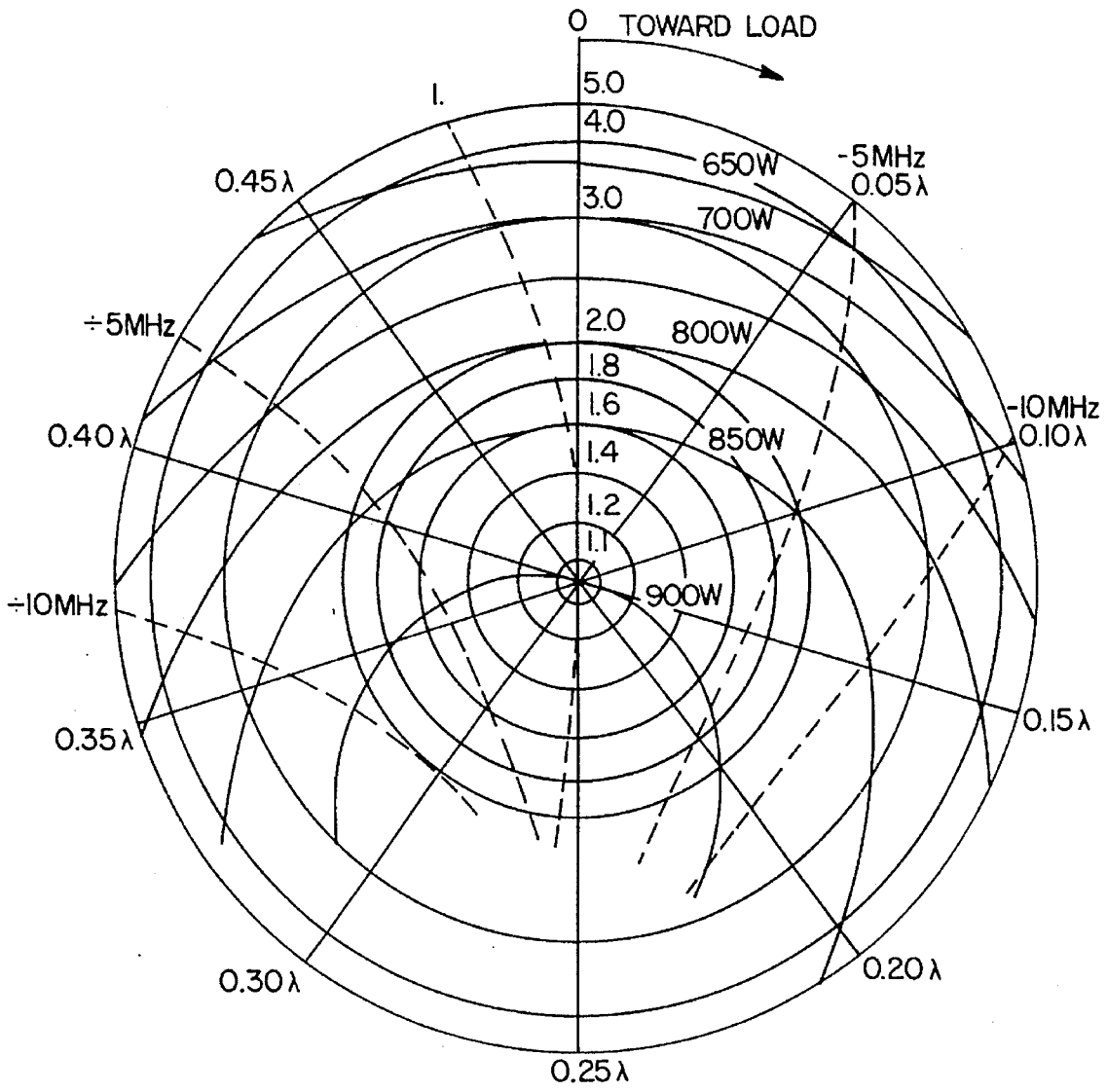
FIG. 1B is a Rieke diagram illustrating the effect of output impedance on the operating frequency of a magnetron.

FIG. 1B is a Rieke diagram illustrating the effects that load impedance has on the power and frequency of the magnetron 11. The Rieke diagram is published by magnetron manufacturers to show the relationship between frequency of operation, load impedance and output power. Frequency shifts of +10 MHz, +5 MHz, −5 MHz and −10 MHz are shown for various reflection coefficients produced by various load conditions on the antenna of the magnetron.

In FIG. 1C, two possible impedance characteristics for the magnetron are provided for illustration. Path I has low frequency to the right side and frequency increasing toward the left. Impedance path II has the opposite orientation.

Let the load characteristic of path I be the load of the magnetron at the reference plane given in the Rieke diagram. Consider low frequency point A on this curve. The impedance lies in the region of the Rieke diagram in which the magnetron is pulled to a lower frequency. The operating point moves still farther from the center because of this pulling. This cumulative frequency change prevents stable magnetron operation in the efficient central portion of the impedance chart except for very low Q resonances.

On the other hand, the impedance of path II provides stable operation by negative feedback. An increase in frequency from the center offsets the impedance to B so that pulling returns operation to a lower frequency and toward the center.

When a quarter-wavelength transmission line is added to the magnetron antenna, the magnetron impedance characteristic of path I resembles impedance characteristic of path II. In general, an unstable load characteristic can be made usable by the addition of an appropriate length of transmission line.

Figure 2:
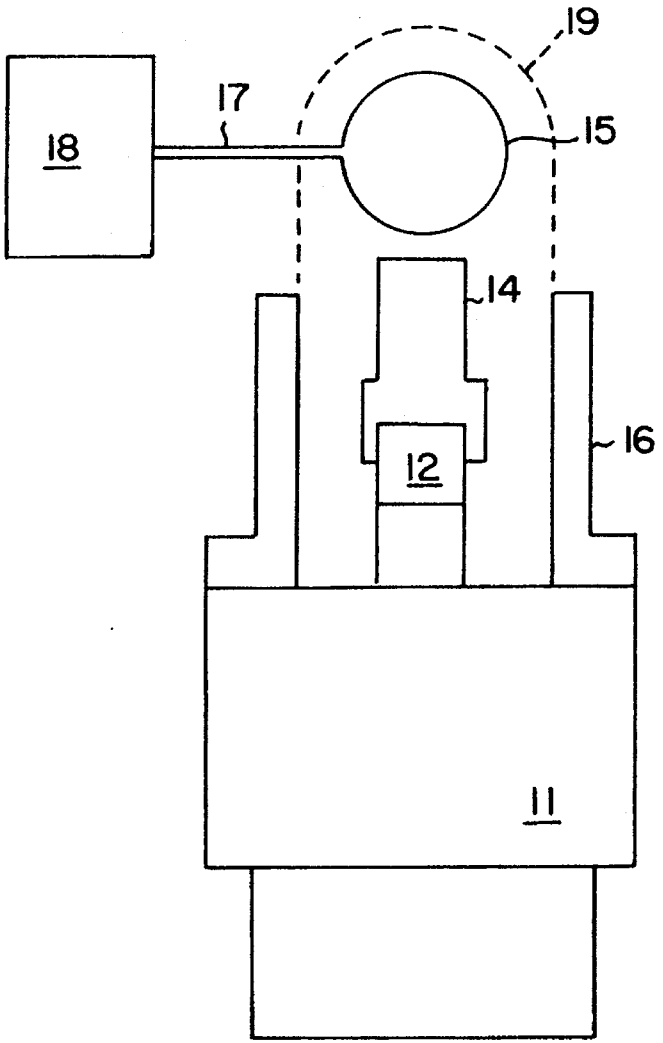
FIG. 2 is a modified version of the embodiment of FIG. 1, employing a transmission line extension for the magnetron antenna.

FIG. 2 shows an embodiment of the invention which adds such a transmission line length to obtain a favorable load impedance characteristic. The embodiment of FIG. 2 contains many of the same elements as FIG. 1 and are therefore identified by the same reference numerals. In the embodiment of FIG. 2, the plane of the impedance is shifted by adding to the antenna 12 an extension 14, as well as lengthening the cylindrical flange 16 to form a coaxial transmission line.

Figure 3:
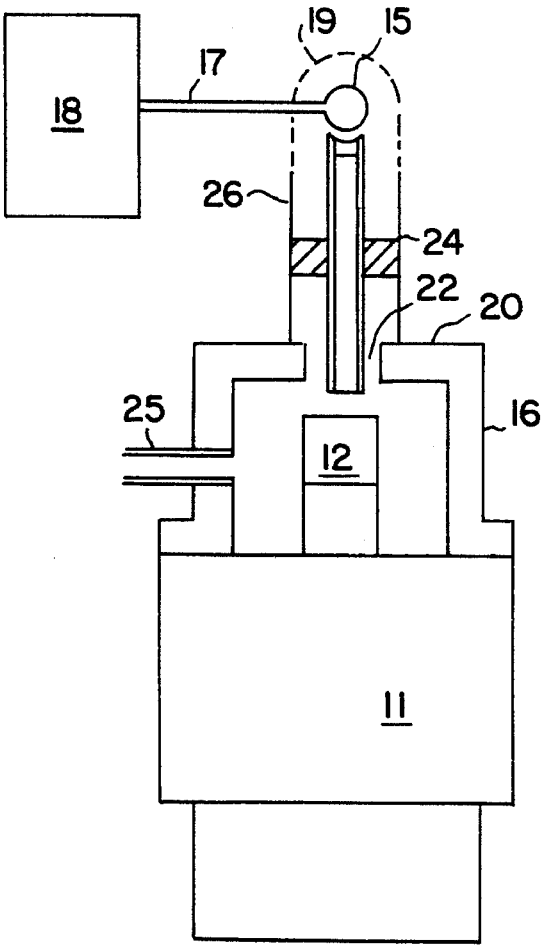
FIG. 3 illustrates yet another embodiment of the invention suitable for small bulbs which provides for air cooling of an electrodeless lamp excited by the magnetron, and a coaxial resonator to boost the voltage applied to the bulb.

FIG. 3 illustrates an embodiment of the invention in which small diameter, high power-density electrodeless gas discharge lamps 15 may be excited by a magnetron 11. Components of this embodiments of which are identical to elements of the previous embodiments are similarly numbered. The smaller diameter lamp 15 requires a higher electric field strength than may be obtained at the end of the magnetron antenna 12. The cylindrical flange 16 includes a cap 20, forming an enclosure which includes an opening 22. Opening 22 receives the center conductor 23 of a coaxial transmission line. The outer conductor 26 of the coaxial transmission line is connected to the cover 20, and thus electrically connected to the magnetron anode. The center conductor 23 has one end spaced apart from the antenna 12. The second end of center conductor 23 has a curvature which has a center of curvature coincident with the center of curvature of the electrodeless lamp 15.

A dielectric air seal 24 is shown which supports the center conductor 23. Center conductor 23 is somewhat shorter than a half wavelength, which produces a high voltage at the end facing electrodeless lamp 15, and also a high voltage near antenna 12. The dielectric support 24 near the middle of the center conductor 23, is at a point where the voltage is a minimum, thus avoiding any substantial dielectric heating.

The embodiment of FIG. 3 also permits air cooling of the small diameter electrodeless lamp 15. The compressed air further cools the electrodeless lamp 15. The flow of compressed air from inlet 25 is directed through a passage in center conductor 23 to the surface of electrodeless lamp 15. The forced air cooling will maintain the envelope temperature of small diameter electrodeless lamps at a safe operating temperature.

Center conductor 23 is somewhat shorter than a half-wavelength. In conjunction with the capacitances to the electrodeless lamp 15 and the antenna 12, this forms a half-wavelength resonator, and provides a higher voltage for exciting electrodeless lamp 15 than is available at the magnetron antenna 12.

Figure 4:
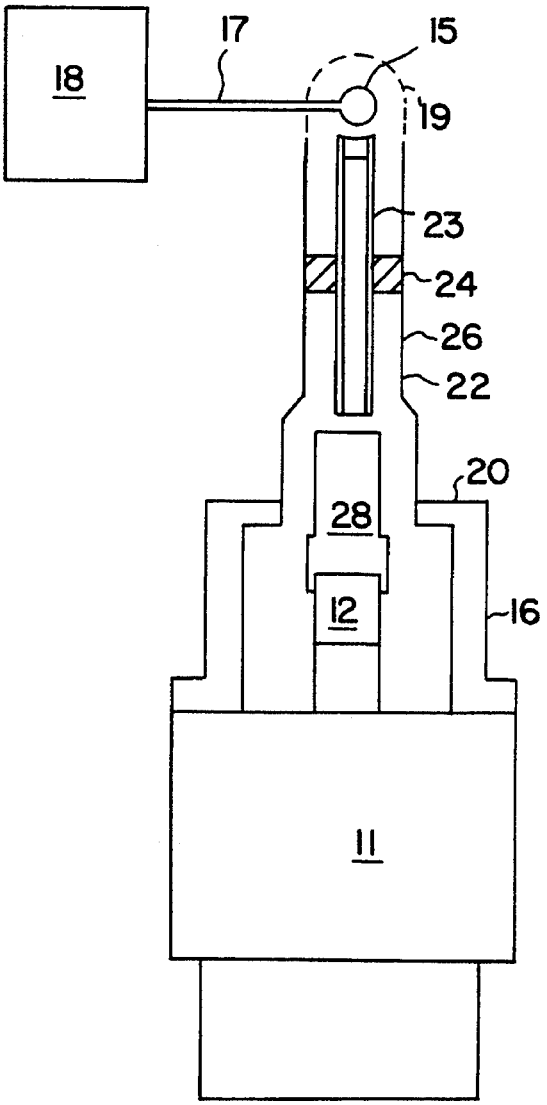
FIG. 4 illustrates another embodiment of the invention which employs a coaxial transmission line coupled to the magnetron antenna for exciting the electrodeless lamp by way of the coaxial resonator.

In FIG. 4, a coaxial extension 28 is added to the embodiment of FIG. 3 to further lengthen the transmission line to obtain a favorable impedance phase, similar to FIG. 2. The embodiment of FIG. 4 contains many of the same elements of FIG. 3 and are similarly numbered.

Figure 6:
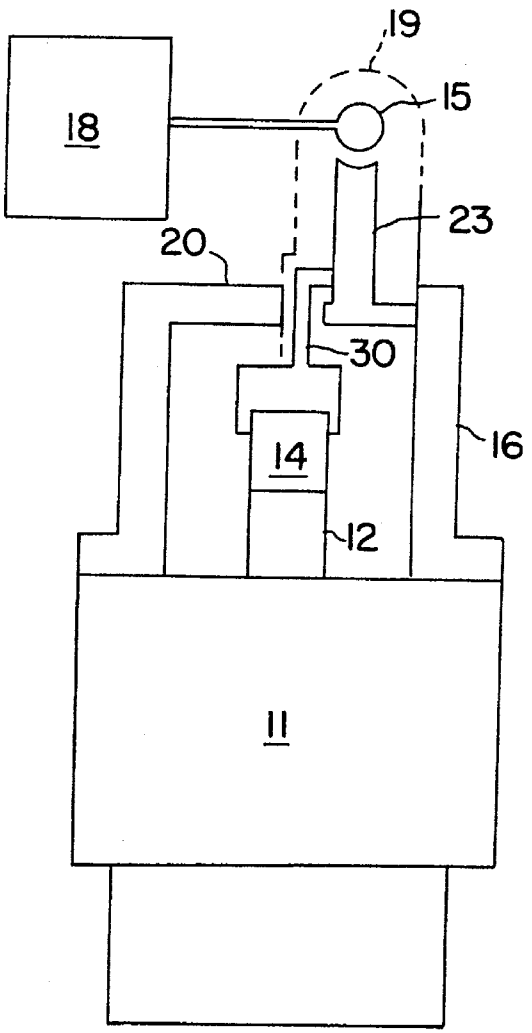
FIG. 6 is yet another embodiment of the invention employing a conducting structure for feeding microwave energy to a section of resonant transmission line which excites an electrodeless lamp.
Figure 5:
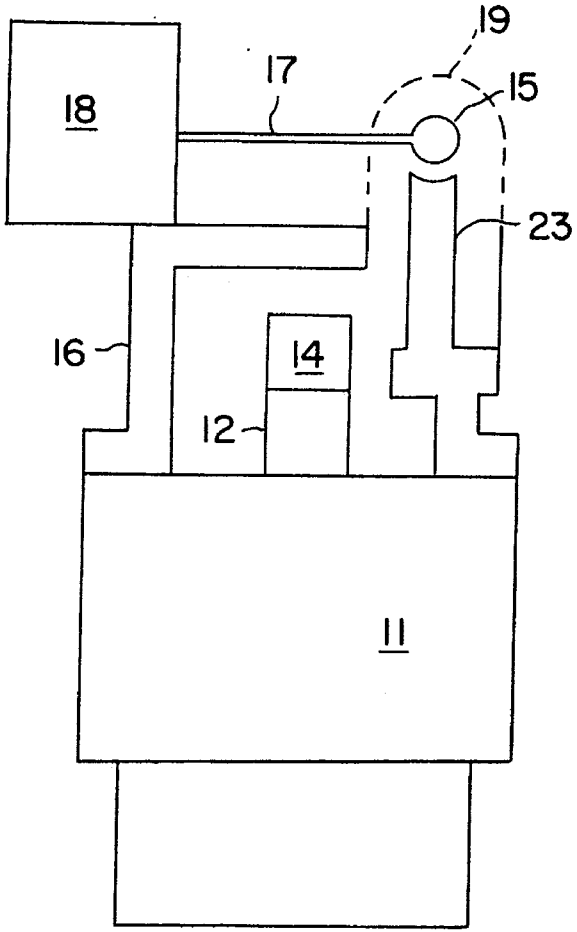
FIG. 5 shows yet another embodiment of the invention wherein energy is coupled capacitively to a short-circuited quarterwave resonator for exciting an electrodeless lamp.
Figure 7:
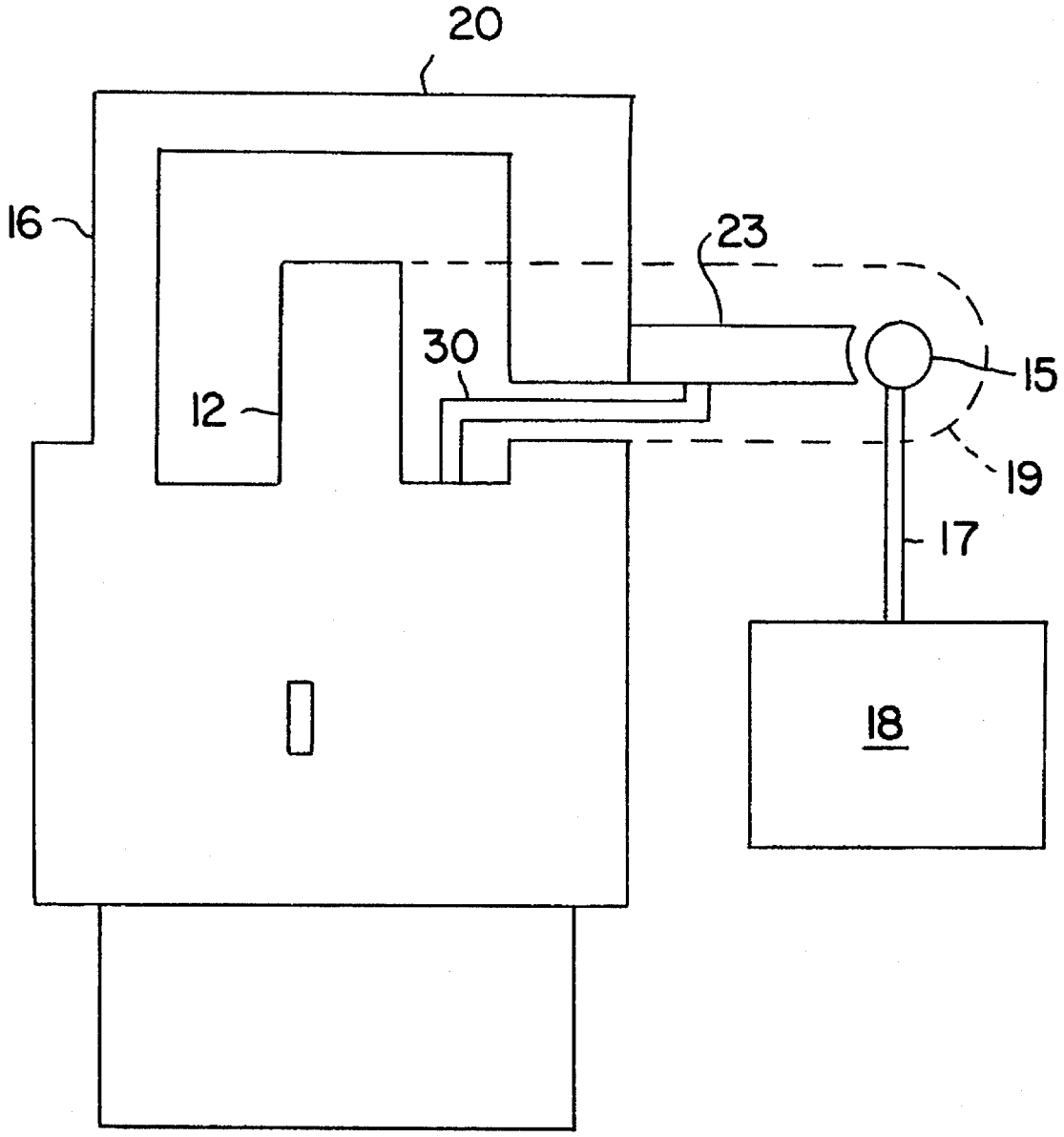
FIG. 7 is another embodiment of the invention illustrating a coupling loop for coupling energy from a magnetron to an electrodeless lamp.

The previous embodiments provide for coupling of microwave energy from a magnetron source 11 to an electrodeless lamp 15 of large and small diameter configurations. The attempt to shift the phase of the loading of resonant circuit in FIGS. 2 and 4 by lengthening the transmission line coupling the antenna 12 and electrodeless lamp 15 may, in some applications, prove to be disadvantageous because of the increase in overall length of the structure. FIGS. 5, 6 and 7 are directed to alternative ways for exciting the electrodeless lamp 15, which may or may not require the coaxial transmission line extensions of the foregoing embodiments. These embodiments include many of the same elements of the previous embodiments and are therefore numbered similarly.

Referring now to FIG. 5, there is shown a quarter wave resonance circuit, weakly coupled to the antenna 12. The quarter wave resonance circuit includes a center conductor 23 which is formed as part of the cylindrical flange 16. The center conductor 23 is excited from microwave energy emitted by the antenna 12.

The quarter wave resonance circuit with the weak coupling provides for a large electric field in the vicinity of the electrodeless lamp 15. The perforated screen 19 contains the electromagnetic radiation while permitting light from the electrodeless lamp 15 to be emitted.

As in the earlier embodiments, the electrodeless lamp 15 is supported on a motor 18 driven shaft 17.

FIG. 6 shows an embodiment having a quarter wave resonant circuit coupled to the antenna 12 by a wire feed 30. The wire feed 30 connects into the resonator formed by conductor 23 at a location which provides an impedance equivalent to the impedance of the magnetron antenna 12 in a matched waveguide. The conductor 30 feeds through an opening in the top of housing 20.

FIG. 7 shows yet another embodiment which is designed to maintain the overall length of the microwave source and feed network to a minimum. A quarter wave resonant circuit is formed by the center conductor 23 and coaxial conductor formed from the screen 19. An inductive loop is formed from the feed conductor 30 connected at one end to the magnetron 11, which exits through a hole in the housing and taps the center conductor 23 at a point which will provide the impedance match to the antenna 12. Power from the inductive loop is coupled to the resonator from the electromagnetic energy created within the housing formed from cylindrical flange 16 and cap 20.

As with the previous embodiments, the electrodeless lamp 15 is supported for rotation on a shaft 17 driven by motor 18. The perforated screen 19 shields the microwave energy from further radiation, while permitting light generated from the electrodeless lamp 15 to be visible.

Thus, there has been described with respect to several embodiments, a coupling structure for coupling microwave electromagnetic energy from a microwave source which is a magnetron to an electrodeless lamp. Each of these structures reduces the overall space requirements and weight of these light-generating systems. Those skilled in the art will recognize yet other embodiments described more particularly by the claims which follow.

What is claimed is:

1. An apparatus for exciting an electrodeless lamp comprising:

a magnetron for generating microwave energy, said magnetron having an antenna coaxially located with respect to a peripheral cylindrical flange thereof and ending in a permanently attached metal cap;

a motor shaft rotatably supporting an electrodeless lamp along a longitudinal axis of said magnetron antenna and spaced apart therefrom; and, a perforated screen enclosing said electrodeless lamp, connected to said peripheral cylindrical flange, thereby defining a coaxial transmission line with said antenna for confining microwave radiation and which is transparent to light emitted by said electrodeless lamp.

2. The apparatus of claim 1, further comprising a coaxial transmission line extension interposed between said antenna and said electrodeless lamp, said coaxial transmission line extension having a center conductor with first and second ends, adjacent said antenna and electrodeless lamp, respectively, having an outer conductor in contact with said peripheral cylindrical flange and said perforated screen.

3. The apparatus of claim 2, wherein said coaxial transmission line has a length which increases an electric field magnitude of said microwave energy incident to the electrodeless lamp.

4. The apparatus of claim 2 further comprising an air inlet extending through said peripheral cylindrical flange, connected to a source of cooling air for supplying cooling air to said electrodeless lamp.

5. The apparatus of claim 4, wherein said center conductor has an air passage connected to said air inlet for delivering said cooling air to a surface of said electrodeless lamp.

6. The apparatus of claim 1 further comprising a coaxial transmission line extension interposed between said antenna and said electrodeless lamp, said coaxial transmission line having a center conductor with first and second ends, said first end connected to said antenna, and said second end being adjacent said electrodeless lamp, said coaxial transmission line extension having an outer conductor in contact with said peripheral cylindrical flange and said perforated screen.

7. The apparatus of claim 1 further comprising means operatively associated with said apparatus for forcing cooling air over said electrodeless lamp.

8. An apparatus for exciting an electrodeless lamp comprising:

a magnetron having a coaxial antenna for supplying microwave energy;

a metallic housing for enclosing said coaxial antenna having an opening for coupling microwave energy outside of said housing:

a first conductor connected inside said housing in a coupling relationship with said coaxial antenna which couples microwave energy from within said housing through said opening to a surface of said electrodeless lamp;

means for supporting said electrodeless lamp for rotation along an axis of said conductor and supporting said lamp at a location spaced a distance from said conductor; and, a perforated screen for enclosing said electrodeless lamp and conductor, connected to said metallic housing thereby defining a coaxial transmission line with said conductor, whereby microwave energy propagates from said coaxial antenna through said housing and coaxial transmission line irradiating the electrodeless lamp.

9. The apparatus of claim 8, wherein said first conductor is connected to an interior of said housing with a second conductor, said second conductor being connected at a first end thereof to said first conductor at a point between ends of said first conductor which provide for a maximum electric field at the electrodeless lamp.

10. The apparatus of claim 9, wherein said second conductor is connected at a second end thereof to said antenna.

11. The apparatus of claim 9, wherein said second conductor is connected at the second end thereof to the housing.

12. An apparatus for exciting an electrodeless lamp comprising:

a magnetron for generating microwave energy, said magnetron having an antenna coaxially located with respect to a cylindrical enclosure;

a motor shaft supporting for rotation an electrodeless lamp, said electrodeless lamp being positioned along an axis of said antenna;

a perforated screen enclosing said electrodeless lamp and electrically connected to said cylindrical enclosure; and, an antenna extension having a first end connected to said antenna and a second end adjacent to and spaced from said electrodeless lamp thereby defining with said cylindrical enclosure a transmission line for transferring microwave energy to said electrodeless lamp.

* * * * *